US005588403A

United States Patent [19]

Williams

[11] Patent Number: 5,588,403

[45] Date of Patent: Dec. 31, 1996

[54] RACK AND PINION VALVE OPERATING SYSTEM

[76] Inventor: Douglas J. Williams, 25940 Coloretti Ct., Valencia, Calif. 91335

[21] Appl. No.: 450,013

[22] Filed: May 25, 1995

Related U.S. Application Data

[63] Continuation of Ser. No. 160,448, Dec. 1, 1993, abandoned, which is a continuation of Ser. No. 971,948, Nov. 4, 1992, abandoned.

[51] Int. Cl.[6] ..... F01L 9/04; F01L 1/30

[52] U.S. Cl. ..... 123/90.11; 123/90.24

[58] Field of Search ..... 123/90.11, 90.15, 123/90.1, 90.16, 90.24, 90.6; 251/129.01, 129.05, 129.15, 129.18

[56] References Cited

U.S. PATENT DOCUMENTS

| | | | |
|---|---|---|---|
| 3,585,974 | 6/1971 | Weber | 123/90.6 |
| 4,256,065 | 3/1981 | Hirt | 123/90.11 |
| 4,777,915 | 10/1988 | Bonvallet | 123/90.11 |
| 4,823,825 | 4/1989 | Büchl | 123/90.11 |
| 4,955,334 | 9/1990 | Kawamura | 123/90.11 |
| 4,972,810 | 11/1990 | Kawamura | 123/90.11 |
| 4,984,541 | 1/1919 | Kawamura | 123/90.11 |
| 5,095,856 | 3/1992 | Kawamura | 123/90.11 |
| 5,099,805 | 3/1992 | Ingalls | 123/90.16 |
| 5,115,772 | 5/1992 | Kawamura | 123/90.11 |
| 5,119,772 | 6/1992 | Kawamura | 123/90.11 |
| 5,131,624 | 7/1992 | Kreuter et al. | 123/90.11 |
| 5,199,392 | 4/1993 | Kreuter et al. | 123/90.11 |
| 5,327,856 | 7/1994 | Schroeder et al. | 123/90.11 |

*Primary Examiner*—Weilun Lo

*Attorney, Agent, or Firm*—Merchant, Gould, Smith, Edell, Welter & Schmidt

[57] ABSTRACT

A valve assembly for an internal combustion engine coupled to a cylinder and a crankshaft and having a valve and an electrical magnetic actuator, wherein the electrical magnetic actuator is interconnected to the valve. A command mechanism is coupled to the valve assembly and the crankshaft. The command mechanism receives signals from the crankshaft to produce an electrical signal, wherein the electrical signal is intermittently sent to the valve assembly. The valve assembly utilizes the electrical signals to intermittently move the valve between an open and closed position of the cylinder.

2 Claims, 8 Drawing Sheets

RACK AND PINION VALVE OPERATING SYSTEM

This is a Continuation of application Ser. No. 08/160,448, filed Dec. 1, 1993, now abandoned, which is a continuation of Ser. No. 07/971,948, filed Nov. 4, 1992, abandoned.

BACKGROUND OF THE INVENTION

1. Field of the Invention

This invention relates generally to internal combustion engines and, in particular, to electromagnetically actuated valve configurations.

2. Description of Related Art

Conventional internal combustion engines include a series of intake and exhaust valves which open and close in a proper sequence and at appropriate times. This opening and closing action allows an air/fuel mixture to be injected into the cylinders, and allows exhaust gases to be expelled from the cylinders. In order to cause the valves to open and close in the proper sequence and at appropriate times, these conventional engines have required complex mechanical arrangements. A sample mechanical arrangement would include gears, camshafts, crankshafts, and timing chains and require precise manufacturing to ensure proper timing between the crankshaft and the camshaft. Further, the interaction in this mechanical arrangement is critical because the cylinders must receive the air/fuel mixture, compress the mixture, ignite the compressed mixture, and expel resulting exhaust gases in a certain timed sequence. Timing is therefore critical to ensure proper and efficient operation. Also, the valve openings included in these arrangements are usually of limited size. The area opening to the cylinder is critical for engine efficiency and operation. The more air/fuel that is allowed into the cylinder bore and the more exhaust gas that is allowed to exit the cylinder bore, the engine will have more power output and efficient operation. To increase the valve opening area, four valve per cylinder engines have evolved. Although these four valve per cylinder engines do increase the surface area for gas to flow in and out of the cylinder bore over conventional two valve per cylinder engines, the geometry of positioning circular openings within the cross-sectional area of the cylinder limits the maximum size of the input and exhaust ports. The mechanical valve movement arrangement will conventionally include the camshaft, which is tied to the crank by means of a timing chain. The camshaft has a series of cam lobes, which raise and lower a push rod, or in overhead cam engines, open or close a valve. The push rods are linked to rocker arms and lifters so that as the cam turns, the lifter rides up on the cam lobe to cause the push rod to move in the upward and downward direction. The rocker arm is pivotally mounted to the head with the push rod pressing at one end of the rocker arm and the other end of the rocker arm pressing against the valve stem so that the motion of the push rod is transferred to cause the valve to move. On an overhead cam engine, the cam lobe contacts the valves directly, and no push rod, lifter, or rocker arm is necessary. The valves on both types of engines are fitted with springs which act to open and close the valve in response to rotation of the associated lobe on the camshaft. These springs often have a compression resistance in excess of 300 pounds.

However, this invention employs electric actuators which may be electric solenoids, to open and close nested valves and has several distinctive advantages. First, unlike the prior art, there are no timing chains, timing gears, push rods, camshafts, lifters, rockers, or high resistance valve springs needed. Hence, the results of this invention are less weight, less friction, less failure of parts, less resistance, less adjustments etc.

Second, the valve assembly may be of nested orientation and thus the entire surface area of the cylinder opening can be utilized to maximize power and efficiency.

Third, although some new inventions shift the relationships between the crankshaft and camshaft, the shifting is in a limited manner. Also, most art in this field involves a fixed relationship between the crankshaft and the camshaft by way of a timing chain and timing gears. The crankshaft turns the camshaft; the camshaft has fixed cam lobes—or a "grind," which controls when the valve opens, how wide, and for how long. Therefore, the relationship between the crankshaft and the valves is fixed and cannot be varied. However, this invention provides a system which has infinitely variable control of these items. Infinite variable control is very desireable because engine performance can be optimized under varying conditions. One needs only to look at how many different camshaft "grinds" that are available to appreciate the value of a variable control between the crankshaft and the valves.

SUMMARY OF THE INVENTION

To overcome the limitations in the related art described above, and to overcome other limitations that will become apparent upon reading and understanding the present specification, the present invention discloses the following: 1) a command mechanism coupled to a valve assembly and a crankshaft (this command mechanism electronically receives the instantaneous position of the crankshaft during rotation); 2) an electrical actuator coupled to the command mechanism and connected to the valve assembly (this electrical actuator electronically receives a signal from the command mechanism which in turn activates the valve assembly accordingly); and, optionally 3) the valve assembly could be a new and unique nested valve assembly.

The command mechanism is coupled to the valve assembly. The valve assembly is connected to an exhaust system, an intake system, and cylinders. The cylinders each have a cylinder bore and an opening into the bore. The valve assembly comprises at lease one standard valve used in automobiles (poppet valve), and a cylinder head. Optionally, the cylinder head could be a separate unit from the valve assembly.

First, the command mechanism processes electronic signals received from the crankshaft to produce new electronic signals that are sent to the electrical actuator. These electronic signals are produced by sensors which are located on the crankshaft and track the crankshaft's instantaneous position during rotation. The command mechanism could also optionally receive sensor data or signals from other sensors, such as vacuum sensors, RPM sensors or air flow sensors, and adjust the signals that are sent to the electrical actuator according to predefined criteria to maximize performance, power, or fuel economy.

Next, the electrical actuator uses the electronic signal received from the command mechanism to intermittently move the valves of the valve assembly toward and away from the cylinder at appropriate times. The valve assembly could also be a nested valve arrangement including an outer valve, and a center valve. This optional center valve, for example, could be coupled to the exhaust system and the optional outer valve would be coupled to the intake system. Also, the cylinder head would have a cavity with the outer valve disposed within that cavity. Thus, in this optional nested valve assembly orientation, the outer valve would move within the cavity of the cylinder head intermittently enabling and disabling gas flow between the cylinder head and the cylinder bore. Further, the center valve would be disposed, and would move intermittently within a hollow shaped outer valve tube of the outer valve enabling and disabling gas to flow between the cylinder head and the cylinder bore.

This optional nested valve assembly configuration cycle would operate as follows: First, the center valve and outer valve would start from idle state so that all gas flow to the cylinder would be disabled. Second, the outer valve and center valve would move together toward the cylinder opening. This action would enable intake gases to flow from the intake system to the cylinder bore. Further, the exhaust passageways would be disabled between the cylinder bore and the exhaust system of the engine. Third, the valves would close and the air fuel mixture would be ignited. Last, the center valve would move toward the cylinder opening independent from the outer valve and thus exhaust fluid flow would be enabled between the cylinder bore and the exhaust system of the engine. However, the outer valve would remain closed preventing fluid flow between the cylinder and intake system. The cycle would begin again.

Moreover, the ability of the engine to draw in and expel gases is critical to efficient operation. Further, the use of this valve assembly is estimated to increase air flow capability by 3 to 12 times over conventional valve configurations while enjoying all of the electrical control benefits previously discussed.

BRIEF DESCRIPTION OF THE DRAWINGS

Referring now to the drawings in which like reference numbers represents corresponding parts throughout.

DETAILED DESCRIPTION OF THE PREFERRED EMBODIMENT

In the following description of the preferred embodiment, reference is made to the accompanying drawings which form a part hereof, and in which is shown by way of illustration of specific embodiments in which the invention may be practiced. Other embodiments may be utilized and structural changes may be made without departing from the present invention in its broadest aspects.

The foregoing description of the preferred embodiment of the invention has been presented for the purposes of illustration and description. The invention is not intended to be exhaustive or to be limited to the precise form disclosed. Many modifications and variations are possible in light of the above teaching. The invention's scope is not intended to be limited only as to what is specifically set forth in the appended claims.

Figure 1:
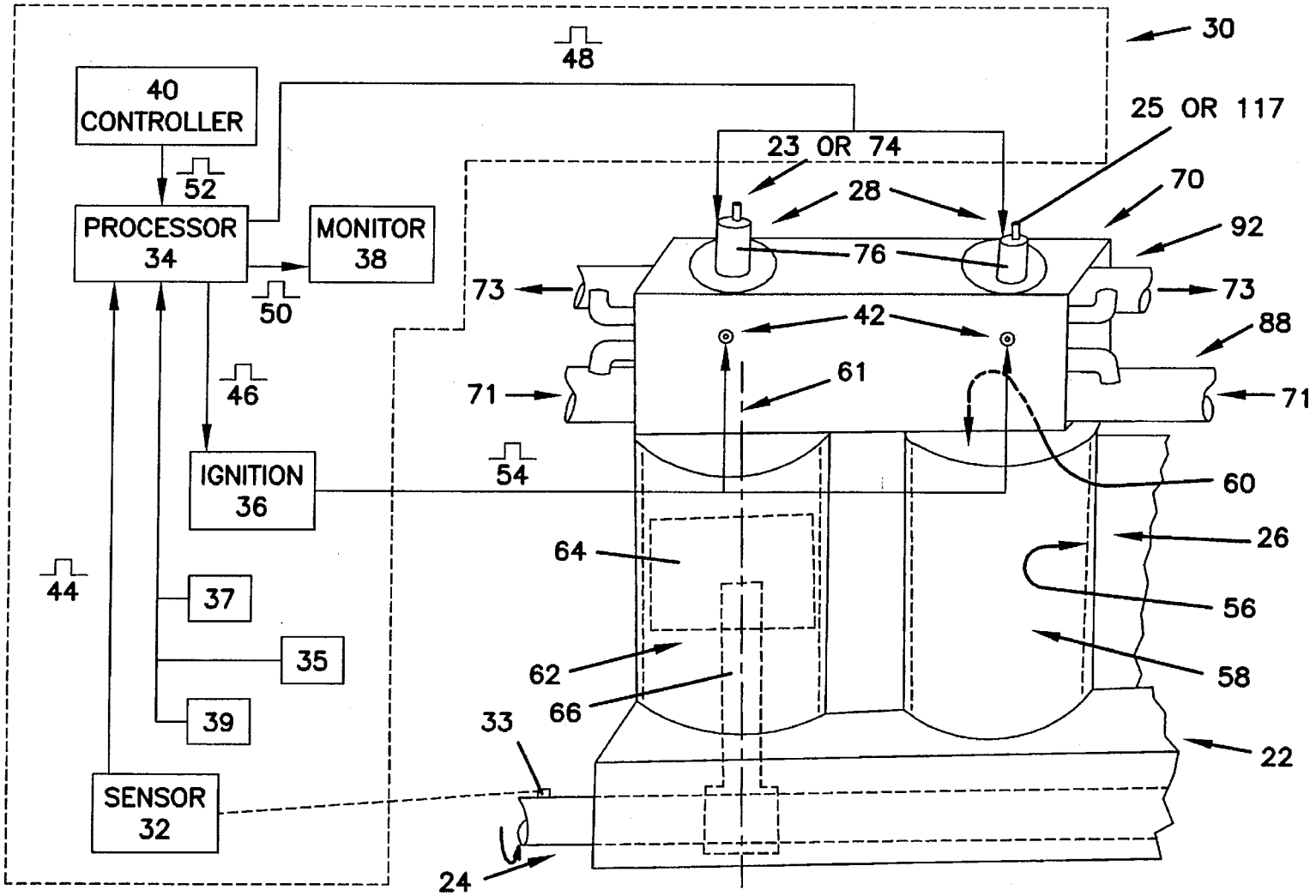
FIG. 1 is a perspective view of an illustrative embodiment of the invention.

As shown in FIG. 1, a rotation sensor apparatus 32, illustrated as part of the command mechanism 30, is coupled, for example, to a crankshaft 24, to sense an instantaneous position on the crankshaft 24 and generate a signal representative of that position. The sensor apparatus 32 may, for example, have an electromagnetic sensor positioned next to the crankshaft 24 for receiving a magnet position 33 on the surface of a crankshaft 24 to generate a pulse, such as a position signal 44. This resulting pulse or position signal 44 may be digitized and transmitted to a processor 34.

The processor 34, illustrated as part of the command mechanism 30, may be a commonly available programmable integrated circuit for receiving the digitized pulse or position signal 44 from the sensor 32. The processor 34 uses the pulse or position signal 44 to identify and track the position of every component coupled to the crankshaft 24. The command mechanism 30 may also include a controller 40 which may be a commonly available programmable processor, a monitor 38, and an ignition 36. The processor 34 is also coupled to an electrical actuator apparatus 76, the ignition 36, the monitor 38, and the controller 40.

First the processor 34 processes the position signal 44 to produce an ignition signal 46 which is sent to the ignition 36. The ignition 36 transforms the ignition signal 46 into a high voltage output which produces a spark signal 54. This spark signal 54 is of high current and is sufficient to cause the spark plug 42 to create a spark in the cylinder bore 58. Also, the processor 34 processes the position signal 44 to produce a driver signal 48 which is sent to the electrical actuator apparatus 76 for activating the valve assembly 28. In addition, the processor 34 processes the position signal 44 to produce a check signal 50 which is sent to the monitor 38 for monitoring various devices of the engine to make sure that the engine is operating properly. Finally, the processor 34 is coupled to the controller 40. The controller 40 receives input from the operator to produce manual signals 52 which are sent to the processor 34 for changing operations of the internal combustion engine manually. Moreover, the processor 34 could optionally receive data or signals from other sensors, such as a vacuum sensor 35, a RPM sensor 37, or an air flow sensor 39, for adjusting the various signals the processor 34 delivers to various components according to predefined criteria to maximize performance, power, fuel economy, or minimize pollution emissions.

Each cylinder 26 has a cylinder wall 56 defining the cylinder bore 58 and a cylinder top opening 60. A piston 62 is located in each cylinder 26 and has a piston head 64 and a piston rod 66, and is disposed within the cylinder bore 58. The piston rod 66 is interconnected to the crankshaft 24. The piston 62 moves relative to the crankshaft 24 within the bore 58 of the cylinder 26 as the crankshaft 24 rotates, but the piston 62 never travels above the cylinder top opening 60.

Also, the piston 62 moves about a central axis 61. The cylinder 26 and the piston 62 have the same central axis 61.

Figure 2:
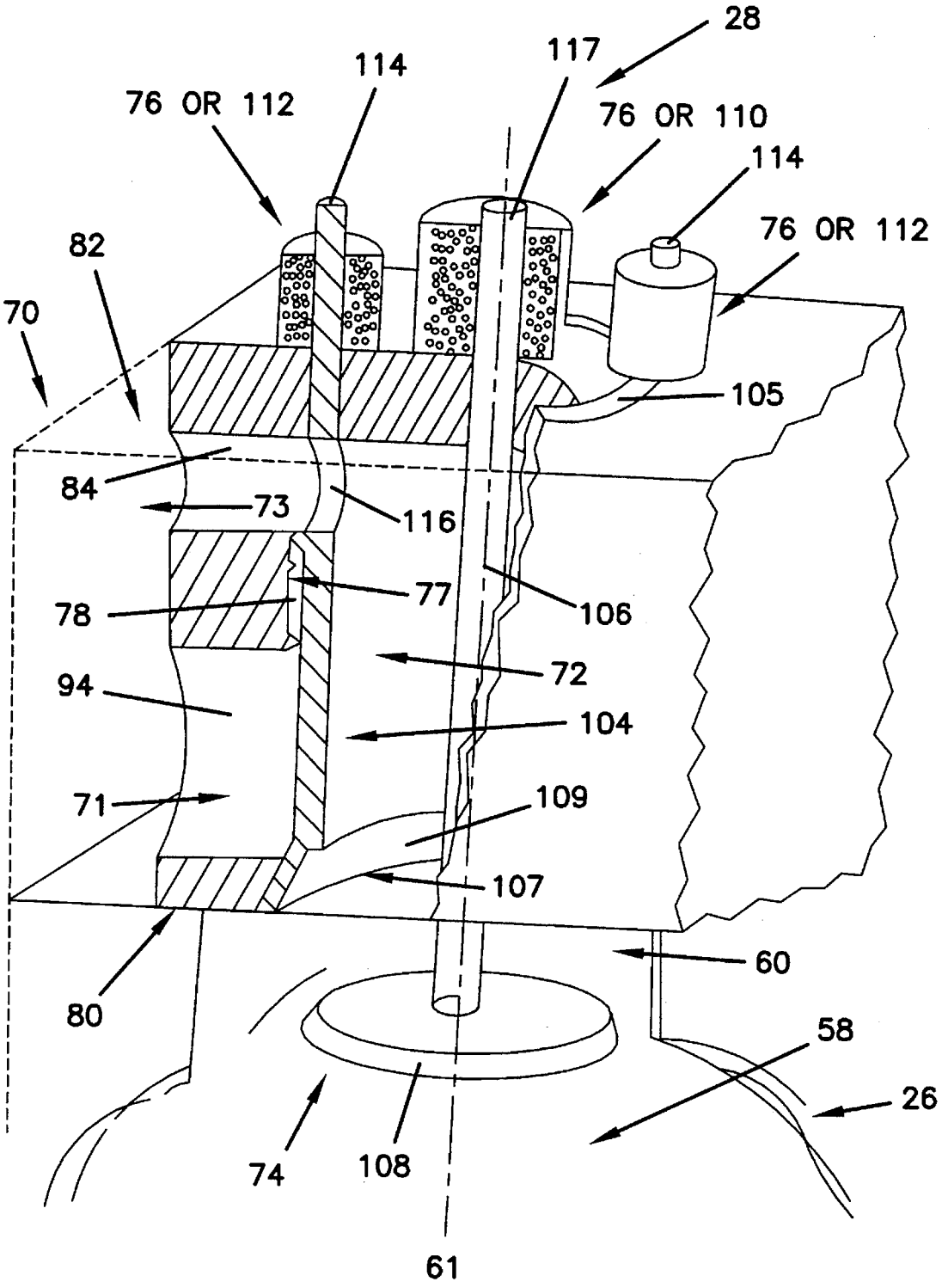
FIG. 2 is a partial cut-away perspective view of an optional nested valve assembly to illustrate the interaction between the cylinder head, the outer valve, the center valve, and the cylinder.

The valve assembly 28 comprises the electrical actuator apparatus 76 and is interconnected to a typical cylinder head 70 that is used in most automobiles (the cylinder head 70 could be a separate or integrated unit), and connected to a valve 23, which could be a standard poppet valve that is used in most automobiles, and the poppet valve 23 has a poppet valve stem 25. Optionally, the valve assembly 28 could be a nested orientation having a generally cylindrical outer valve 72, and a center valve 74 as shown in FIG. 2. The optional nested orientation has a cylinder head 70 having inner walls 77 defining a cavity 78 and a base 80 juxtaposed adjacent the cylinder top opening 60 to form a seal between the cylinder head 70 and the cylinder 26. The cylinder head 70 also has a head top 82 located at an opposite end of the base 80. The cylinder head 70 has at least one exhaust passageway 84 coupled to the cavity 78. An air/fuel mixture 71 flows into the head 70 and exhaust gas 73 flows out of the exhaust passageway 84. The exhaust passageway 84 is connected to an exhaust manifold 92 as shown in FIG. 1.

Figure 3A:
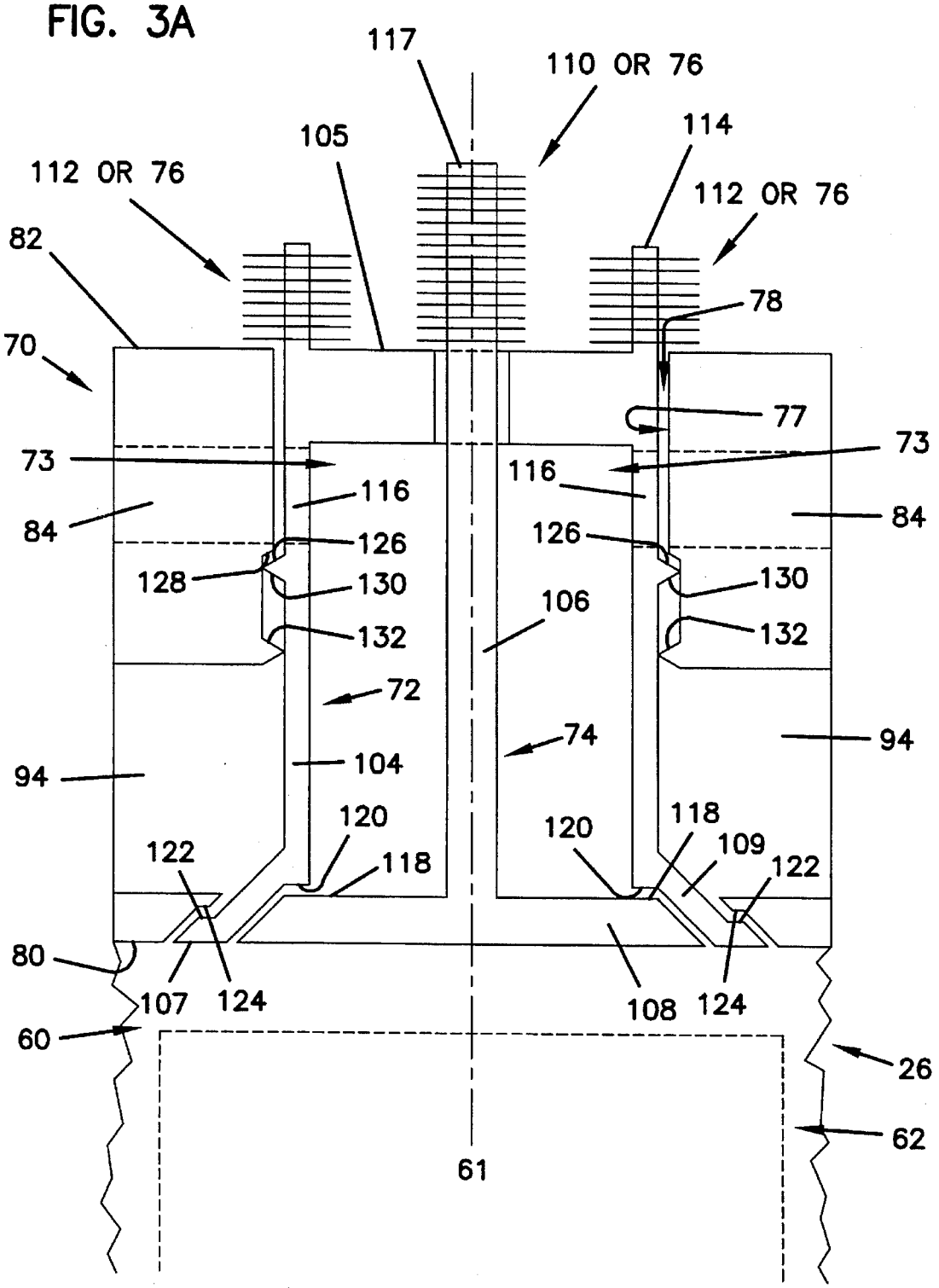
FIG. 3A is a side view of an optional nested valve assembly according to the invention in a closed position.
Figure 3B:
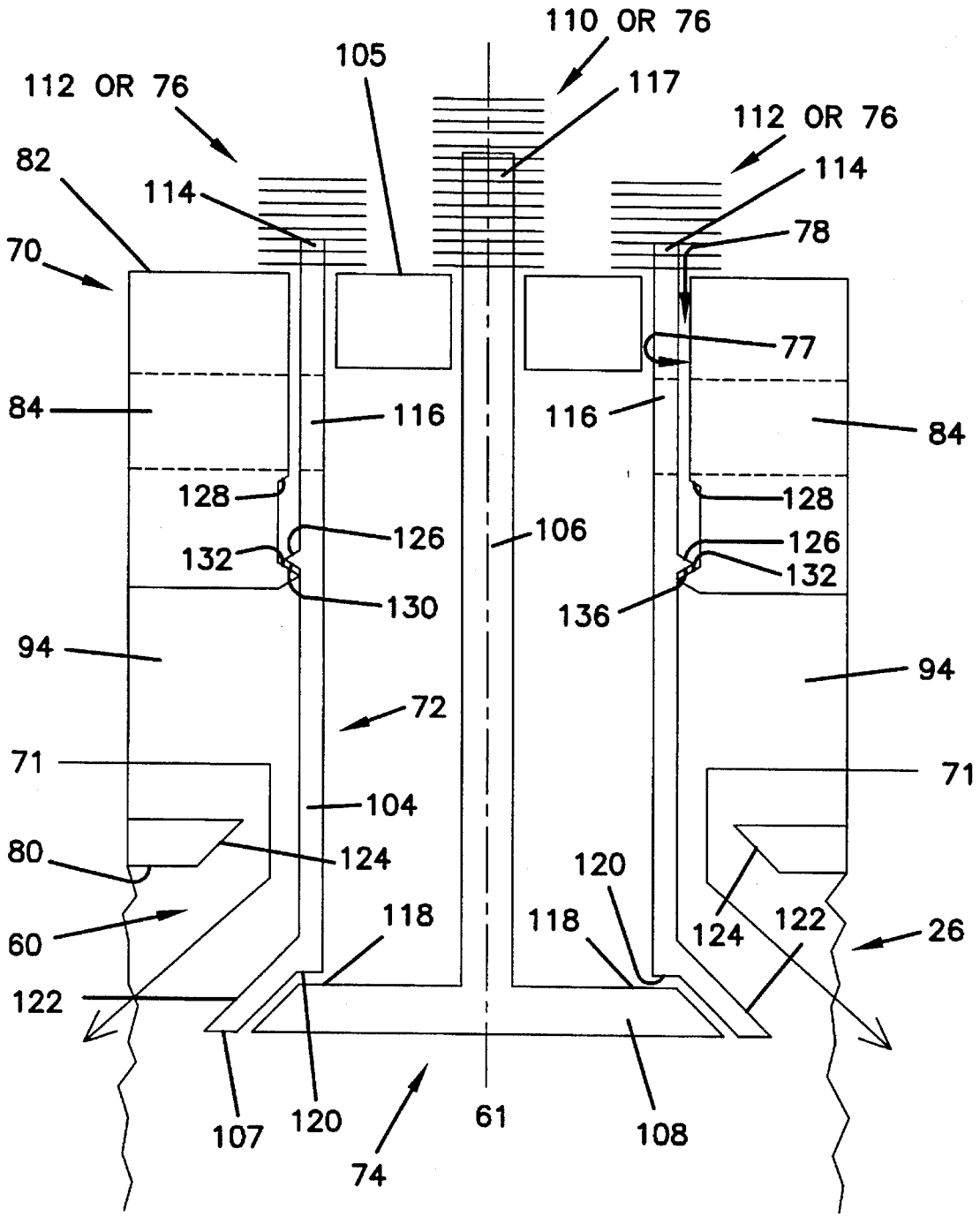
FIG. 3B is a side view of an optional nested valve assembly with the center valve in a closed position and the outer valve in an open position relative to the cylinder.

Exhaust gas 73 is originally created in the bore 58 as a result of combustion of the air/fuel mixture 71 and flows from the cylinder 26 through the cylinder head 70, through the exhaust passageway 84, and into the exhaust manifold 92 of FIG. 1 when the center valve 74 is opened as shown in FIG. 3B.

Figure 3C:
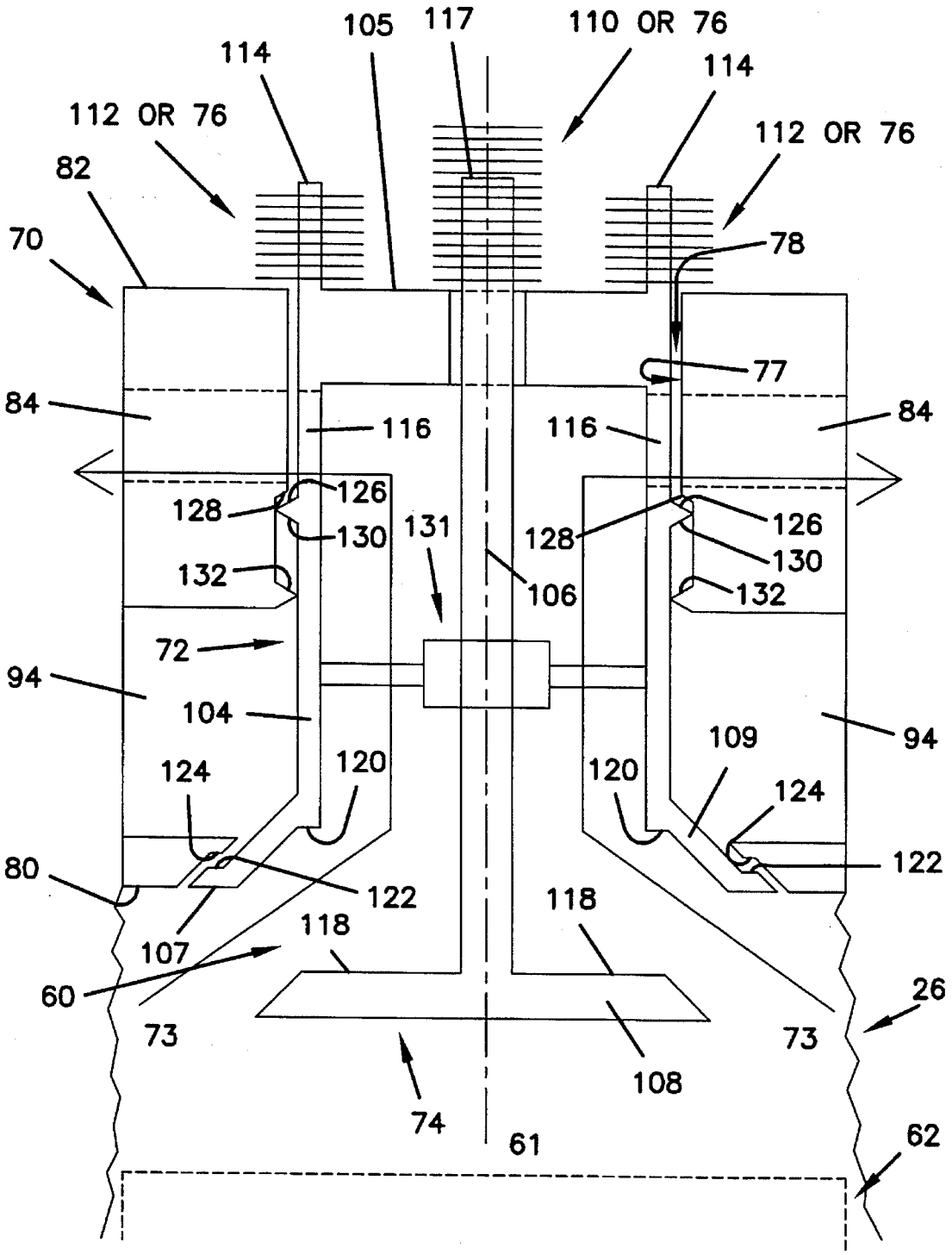
FIG. 3C is a side view of an optional nested valve assembly according to the invention with the center valve in an opened position and the outer valve in a closed position relative to the cylinder.

Further, as shown in FIG. 2, the head 70 has at least one intake passageway 94 coupled to the cylinder head 70 and the cavity 78. As shown in FIG. 3C, the air/fuel mixture 71 flows into the head 70 via the intake passageway 94 and originates in the intake manifold 88 of FIG. 1 when the outer valve 72 is opened.

As shown in FIGS. 3A, 3B, 3C, the outer valve 72 of the optional nested valve assembly defines a hollow shaped outer valve tube 104 and is disposed within the cavity 78 and moves along the central axis 61. The outer valve tube 104 has a top end 105 located near the head top 82 and a bottom end 107 located near the cylinder top opening 60. The top end 105 may have at least two outer valve posts 114 extending from the top end 105. The bottom end 107 has a substantially circular ring shaped receiving head 109. As shown in FIG. 2, the optional outer valve 72 has at least one exhaust port 116 substantially the same size as the exhaust passageway 84. As shown in FIG. 2, the optional center valve 74 also moves along the central axis 61 and is disposed in a nested orientation within the outer valve tube 104. The center valve 74 has a center valve rod 106, a substantially disc shaped center valve head 108, and a shaft end 117. The center valve head 108 is positioned at the base 80 and at the top opening 60 of the cylinder 26. The center valve rod 106 is interconnected to the center valve head 108. Both the center valve rod 106 and the center valve head 108 are aligned along the central axis 61. The center valve rod 106 extends from the center valve head 108 through both the top 82 portion of the cylinder head 70 and above the top end 105 of the outer valve tube 104. The center valve rod 106 is interconnected at its shaft end 117 to the electrical actuator apparatus 76. The outer valve 72 is interconnected to the electrical actuator apparatus 76 via the outer valve posts 114. As shown in the optional nested embodiments of FIGS. 3A, 3B, 3C, the center valve head 108 has a substantially flat center valve seat 118 facing the opening of the hollow outer valve tube 104. The outer valve 74 has a substantially flat exhaust outer valve seat 120 facing the cylinder top opening 60. The center valve seat 118 and the exhaust outer valve seat 120 contact each other intermittently in response to movement of the outer valve 72 and center valve 74. The outer valve 72 has a substantially flat intake outer valve seat 122 facing the opening of the hollow outer valve tube 104. The cylinder head 70 has an intake head seat 124 facing the cylinder top opening 60. The intake outer valve seat 122 and the intake head valve seat 124 contact each other intermittently in response to movement of the outer valve 72 and center valve 74.

Further, the outer valve 72 has a substantially flat top seat 126 located near the exhaust port 116. The cylinder head 70 has a substantially flat upper head seat 128 located near the exhaust passageway 84 of the cylinder head 70. The top seat 126 and the upper head seat 128 contact each other at the same angle intermittently in response to movements of the outer valve 72. The outer valve 72 has a substantially flat bottom seat 130 located near the exhaust port 116 and on the opposite side of the top seat 126. The cylinder head 70 has a substantially flat lower head seat 132 located near the intake passageway 94. The bottom seat 130 and the lower head seat 132 contact each other at the same angle intermittently in response to movements of the outer valve 72.

The electrical actuator apparatus 76 of FIG. 2 is electrically coupled to the processor 34 of FIG. 1 and receives the driver signal 48 from the processor 34 to intermittently move the poppet valve 23, or move the optional outer valve 72 and the optional center valve 74. The electrical actuator apparatus 76 has a center actuator 110 located near the head top 82 of the cylinder head 70. The center actuator 110 is interconnected to the poppet valve stem 25, or the center valve stem 106, and is coupled to the controller 34, for receiving the driver signal 48 for intermittently moving the poppet valve 23 at appropriate times. The electrical actuator apparatus 76 may also have outer actuators 112 located near the head top 82 and interconnected to the outer valve 72 at the outer valve posts 114 of the outer valve 74. The outer actuators 112 are also coupled to the controller 34 for receiving the driver signal 48 which moves the outer valve 72 at appropriate times.

Figure 4:
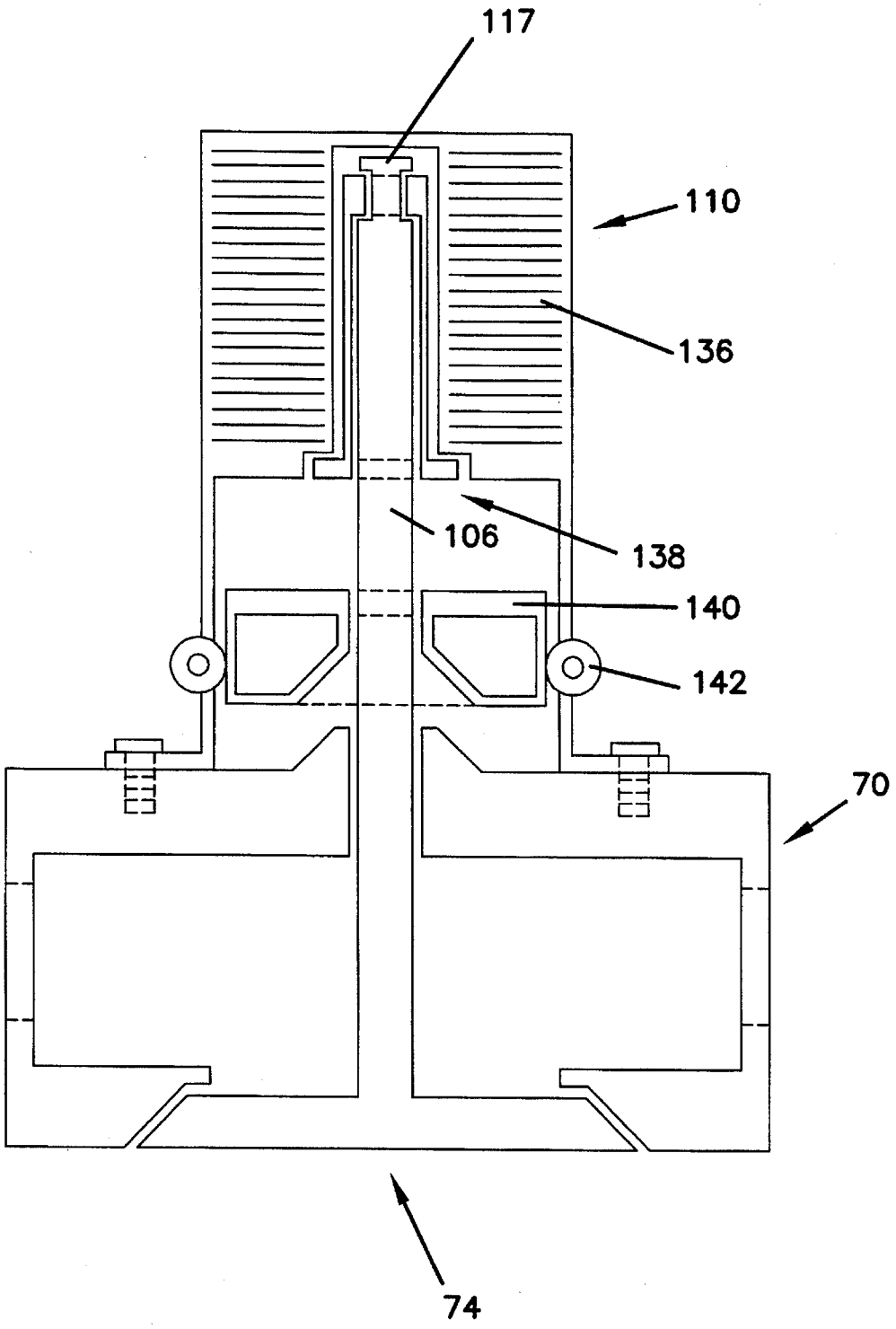
FIG. 4 is a side view of a valve assembly with a standard poppet valve used in the automobile industry and a center solenoid.

The center actuator 110 and the outer actuators 112, could optionally be a center solenoid 111, as shown in FIG. 4, and outer solenoids 115 respectively. Both the center solenoid 111 and the outer solenoids 115 would each comprise an electrically energized solenoid wire coil 136, a plunger 138, a height limiter 140 which may be stationary or movable in response to a height limiter motor 142. The plunger 138 is coupled to the solenoid wire coils 136, the height limiter 140, the height limiter motor 142, and the poppet valve stem 25 or coupled to the center valve stem 106 and the outer valve posts 114 in the optional nested assembly case. Further, the processor 34 may send different gradients of current or power stages via the driver signal 48 to the solenoid wire coils 136.

Figure 5:
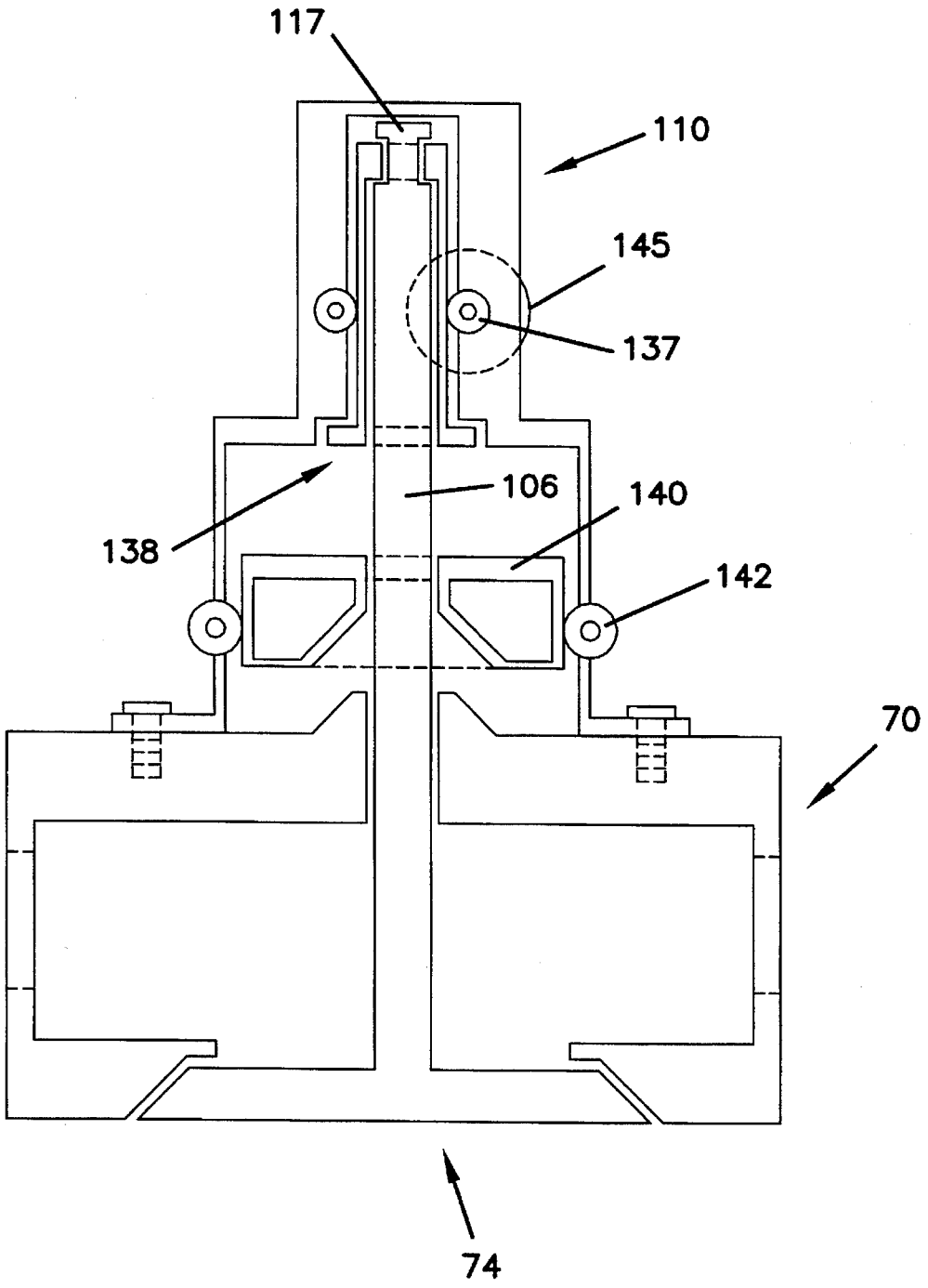
FIG. 5 is a side view of a valve assembly with a standard poppet valve used in the automobile industry and a rack and pinion gear.

Also, the valve assembly 28 of FIG. 1 may be a center actuator 110 as shown in FIG. 5, and an outer actuator 112, substantially the same as the center actuator 110 described above, but utilizing a rack and pinion gear 137 instead of solenoid wire coils 136. The center actuator 110 and the outer actuator 112 may optionally include a rack & pinion gear 137, a plunger 138, a height limiter 140, and a height limiter motor 142. The plunger 138 is coupled to the rack & pinion gear 137, the height limiter 140, the height limiter motor 142, and the poppet valve stem 25 or the center valve stem 106 and the outer valve posts 114 in the optional nested valve assembly.

Figure 6:
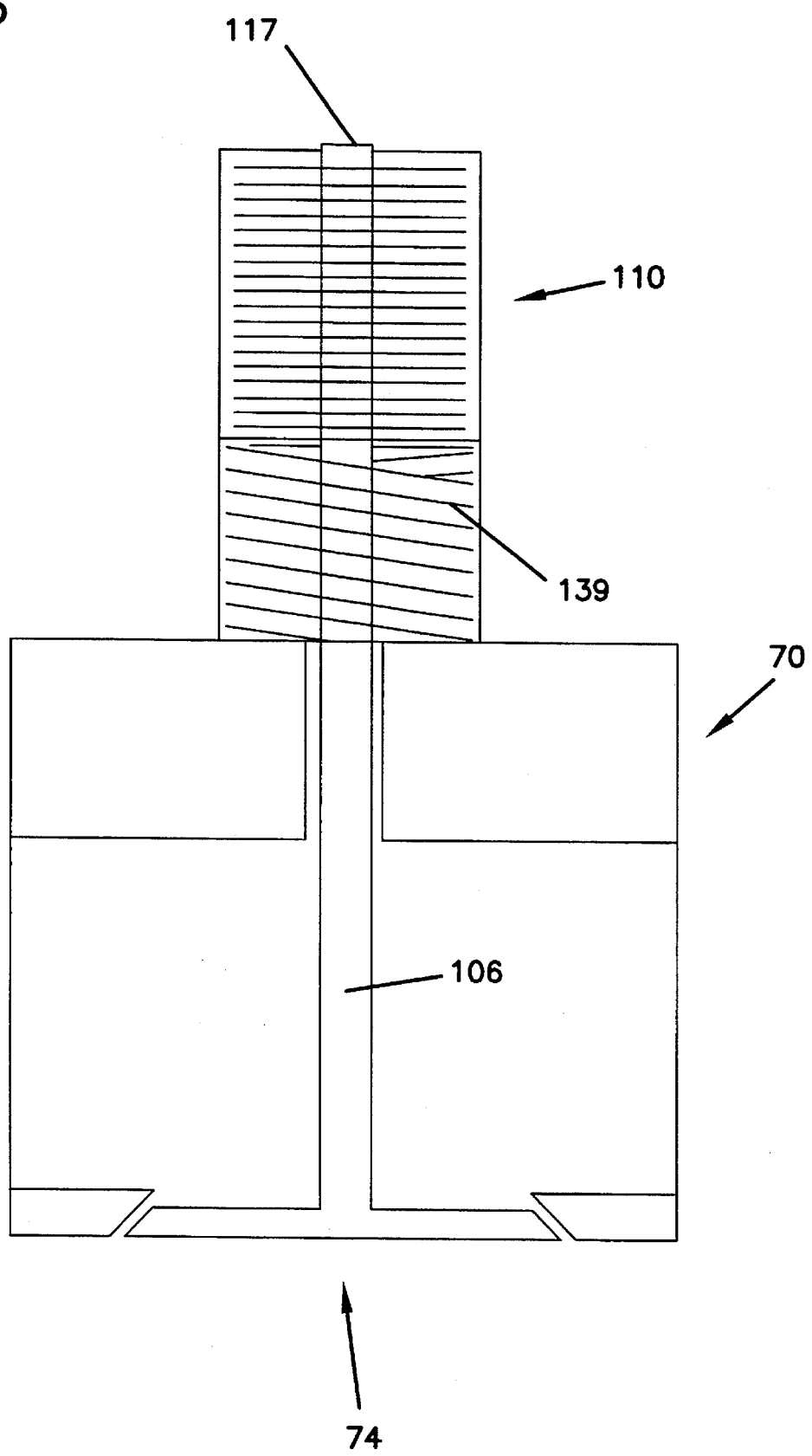
FIG. 6 is a side view of a valve assembly with a standard poppet valve used in the automobile industry and a center solenoid incorporating a return spring.

In addition, the valve assembly 28 of FIG.1 may comprise a center actuator 110 as shown in FIG. 6, an outer actuator 112, and lightweight return springs 139. The lightweight return springs 139 are located inside the center actuator 110 and the outer actuator 112.

Further, the poppet valve 23 or optional center valve 74 may have a retainer guide 131, as shown in FIG. 3B, interconnected to the cylinder head 70, or interconnected to the outer valve 72 in the optional nested orientation, and coupled to the poppet valve stem 25 or coupled to the center valve stem 106 in the optional nested orientation.

OPERATION

As shown in FIG. 1, the sensor 32 which may be, optical, magnetic or any other type tracks the crankshaft 24 during rotation by locating, e.g., an optical code or a groove or magnet position 33 on the crankshaft 24 during rotation to identify an instantaneous position of the crankshaft 24. The crankshaft's 24 relative connection with the cylinder piston 62 allows the sensor 32 to also track the exact position of the piston 62 during the piston's 62 motion in the cylinder 26 via the crankshaft 24. The sensor 32 accomplishes this by first sensing the crankshaft's 24 position. Next, the sensor 32 utilizes a preprogrammed relation constant (relationship between the crankshaft 24 and piston 62 connection) to calculate the position signal 44 which converts the relative position of the crankshaft 24 to a relative position of the piston 62. The sensor 32 then sends the position signal 44 to the processor 34. The processor 34 processes the position signal 44 and calculates the driver signal 48, which determines when the poppet valve 23 or the optional outer valve 72 and center valve 74 will move. The driver signal 48 is delivered from the processor 34 to the electrical actuator apparatus 76 during piston 62 movement within the cylinder 26.

Thus, piston 62 positioning and movement is extremely important because the piston 62 in the cylinder bore 58 has critical positions for proper engine operation and efficiency. One movement of the piston 62 that is important is when the piston 62 is moving away from the cylinder top opening 60 and is either drawing an air/fuel mixture 71 into the cylinder bore 58 or igniting an air/fuel mixture 71. Another movement that is important is when the piston 62 is moving toward the cylinder top opening 60 and is either compressing the air/fuel mixture 71 or expelling burned exhaust gases 73 from the cylinder.

Hence, each full cycle of movement of the poppet valve 23, or the optional outer valve 72 and center valve 74, operates as follows: 1) the poppet valve 23 or the optional center valve 74 and outer valve 72, starts in idle state, and thus, all fluid flow 71/73 is disabled to and from the cylinder 26; 2) the poppet valve 23, or the optional outer valve 72, moves toward the cylinder top opening 60 (in the optional outer valve 72 case, the outer valve 72 will force the center valve 74 to move in tandem with the outer valve 72 toward the cylinder top opening 60), and thus, all air/fuel mixture 71 is enabled between the cylinder bore 58 and the intake manifold 88 (in the optional outer valve 72 case, all exhaust gas 73 flow is disabled between the cylinder bore 58 and the exhaust manifold 92); 3) the poppet valve 23 or the optional outer valve 72 and center valve 74, is closed and the air/fuel mixture 71 is ignited; and 4) the poppet valve 23, or the optional center valve 74, moves toward the cylinder top opening 60 (in the optional center valve 74 case, the center valve 74 moves independent from the outer valve 72), and thus, exhaust gas 73 flow is enabled to be expelled from the cylinder bore 58 to the exhaust manifold 92. The poppet valve 23, or the optional outer valve 72 and center valve 74, moves appropriately according to the piston 62 position within the cylinder bore 58. Therefore, this cycle enables and disables the air/fuel mixture 71 to be injected into the intake manifold 88, and enables and disables exhaust gas 73 to be expelled from the cylinder bore 58 to the exhaust manifold 92.

Moreover, when the sensor 32 sends the position signal 44 to the processor 34, the processor 34 processes the position signal 44 and calculates the ignition signal 46, for determining when the spark plugs 42 will fire. Next, the ignition signal 46 is sent to the ignition 36 for creating a high voltage output in form of a spark signal 54. Thus, the spark signal 54 is delivered to the spark plugs 42 from the ignition 36 when the piston 62 is moving away from the cylinder top opening 60.

Further, the processor 34 processes the position signal 44 to instantaneously calculate a check signal 50. The check signal 50 determines engine performance, vacuum rating, and idle speed. The check signal 50 is sent to various monitoring devices 38 for each calculation. Thus, the processor 34 can monitor various engine operations at any instant in time.

The center solenoid 110, as shown in FIG. 4, and the outer solenoids 112, as shown in FIG. 2 would each comprise an electrically energized solenoid wire coil 136 of wire. A magnetic field within the solenoid wire coil 136 is produced when the driver signal 48 is received by the solenoid wire coil 136 via the electrical actuator apparatus 76. The magnetic field produced by the solenoid wire coil 136 magnetizes a plunger 138 and causes the plunger 138 to move to a specified position within the solenoid wire coil 136. Thus, since the plunger 138 is coupled to the valve 23, the valve 23 can be moved according to the processor 34 via the driver signal 48.

FIG. 3A shows all valves closed for the optional nested valve assembly. When all valves are closed for the optional nested valve assembly, the center valve seat 118 abuts securely against the exhaust sleeve valve seat 120 to form a seal. Thus, exhaust gas 73 flow is disabled between the cylinder top opening 60 and the exhaust manifold 92. Also, the intake outer valve seat 122 abuts securely against the intake head seat 124 to form a seal and thus air/fuel mixture 71 is disabled between the cylinder top opening 60 and the intake manifold 88.

Further, the upper head seat 128 abuts securely against the top seat 126 causing the exhaust passageway 84 to be aligned with the exhaust port 116. Although there is an open channel between the exhaust manifold 92 and the outer valve tube 104, the driver signal 48 in FIG. 1 is not activating the outer valve 72 or the center valve 74 at this time, and thus, no exhaust gas flow 73 exists between the exhaust manifold 92 and the cylinder 26. Therefore, no exhaust gas 73 will exist between the cylinder top opening 60 and the cylinder head 70.

FIG. 3B of the optional nested valve assembly shows the outer actuators 112 activated and the center actuator activated 110. This is accomplished when the processor 34 of FIG. 1 sends the driver signal 48 accordingly. The center valve seat 118 stays in contact with the exhaust outer valve seat 120 enabling the air/fuel mixture 71 to be injected into the cylinder 26. Moreover, since the intake outer valve seat 122 and the intake head seat 124 are not in contact, the air/fuel mixture 71 flows between the intake passageway 94 and the cylinder top opening 60. The lower head seat 132 will contact with the bottom seat 130 when both the center actuator 110 and outer actuators 112 are activated. Also, the exhaust passageway 84 is no longer aligned with the exhaust port 116 preventing exhaust gas flow 73 between the exhaust passageway 84 and the hollow shaped outer valve tube 104. Hence, the air/fuel mixture 71 is injected from the intake manifold 88 to the intake passageway 94 and travels between the outer valve 72 and the cylinder head 70, to enter into the cylinder top opening 60.

FIG. 3C of the optional nested valve assembly shows the center valve 74 open. The center actuator 110 receives the driver signal 48, of FIG. 1, from the processor 34 and activates the center valve 74 to move into the cylinder top opening 60 for enabling exhaust gas 73 to flow be expelled from the cylinder top opening 60 to the exhaust passageway 84. During this activation, the center valve 74 disengages with the exhaust outer valve seat 120.

Hence, the exhaust passageway 84 is still aligned with the exhaust port 116, and thus exhaust gas 73 is expelled from the cylinder top opening 60 through the exhaust passageway 84 via the hollow shaped outer valve tube 104. Therefore, exhaust gasses 73 will be forced by suction to flow from the cylinder top opening 60 through the hollow shaped outer valve tube 104 and then through the exhaust passageway 84. During this time, the intake outer valve seat 122 stays in sealed contact with the intake head seat 124, and the upper head seat 128 stays in sealed contact with the top seat 126 while the outer valve 72 remains idle.

The center actuator 110 and the outer actuators 112, could optionally be a center solenoid 110, as shown in FIG. 4, and outer solenoids 112 respectively. Both the center solenoid 110 and the outer solenoids 112 would each comprise an electrically energized solenoid wire coil 136 of insulated wire, a plunger 138, a height limiter 140, and a height limiter motor 142. The plunger 138 is coupled to the solenoid wire coils 136, the height limiter 140, the height limiter motor 142, and the poppet valve stem 106 or coupled to the center valve stem 106 and the outer valve posts 114 as shown in FIG. 2 in the optional nested assembly case. The plunger 138 regulates the distance the poppet valve 23, or the center valve 74 and outer valve 72, travels into the cylinder top opening 60 by abutting against the height limiter 140. The height limiter 140 is adjusted by the height limiter motor 142.

Optionally, after the valve 23 is moved toward the cylinder top opening 60, the polarity in the solenoid wire coils 136 may be reversed for moving the valve 23 in the opposite direction to return the valve 23 to idle state. Further, the processor 34 may send different gradients of current or power stages via the driver signal 48 to the solenoid wire coils 136. The power stages may, e.g., start by supplying a low current to the solenoid wire coils 136 and then gradually increasing the current supplied to the solenoid wire coils 136 in stages. Optionally this staging can be effected by starting with a high current and gradually decreasing the current supplied to the solenoid. Thus, the mechanical force on the plunger 138 is increased as the current supplied to the solenoid wire coils 136 increases. This gradual increase in current serves to overcome the initial inertia of valve 23 movement. Thus, power staging would aid in regulating both the speed in which the valve 23 moves and the distance the valve 23 moves.

The valve assembly 28 of FIG. 1 may be a center actuator 110 as shown in FIG. 5, and an outer actuator 112, substantially the same as the center actuator 110 described above, but utilizing a rack and pinion gear 137 instead of solenoid wire coils 136. The center actuator 110 and the outer actuator 112 may optionally include a rack & pinion gear 137, a plunger 138, a height limiter 140, and a height limiter motor 142. The plunger 138 is coupled to the rack & pinion gear 137, the height limiter 140, the height limiter motor 142 and the poppet valve stem 25 or coupled to the center valve stem 106 and the outer valve posts 114. Pinion gear 137 is driven by an electric motor 145 in a conventional manner. The plunger 138 regulates the distance the poppet valve 23 or the center valve 74 and outer valve 72 travels into the cylinder top opening 60 by abutting against the height limiter 140. The height limiter 140 is adjusted by the height limiter motor 142.

In addition, the valve assembly 28 of FIG.1 may comprise a center actuator 110 as shown in FIG. 6, an outer actuator 112, and lightweight return springs 139. The lightweight return springs 139 are located inside the center actuator 110 and outer actuator 112. The processor 34 sends the driver signal 48 to each actuator 110/112 and the return spring 139 would compress the return spring 139 and then allow the return spring 139 to expand for resiliently activating the poppet valve 23, or optional center valve 74 and outer valve 72. Thus, this expansion of the return spring 139 moves the poppet valve 23, or optional center valve 74 and outer valve 72 to each valve's idle position.

Also, the poppet valve 23 or optional center valve 74 may have a retainer guide 131, as shown in FIG. 3B interconnected to the cylinder head 70 or interconnected to the outer valve 72, in the optional nested orientation, and coupled to the poppet valve stem 25 or coupled to the center valve stem 106 for stabilizing and keeping the poppet valve 23 or the center valve 74 moving substantially along the central axis 61. This is accomplished by stabilizing the poppet valve stem 25 or the center valve stem 106 while the respective valve moves within the retainer guide 131.

I claim:

1. A valve assembly for an internal combustion engine having a crankshaft for moving a piston within a cylinder, the cylinder having a bore, at least one opening into the bore, and a head interconnected at the cylinder opening and the head having a cavity with the cavity having at least one opening, comprising;

a) a valve disposed within the cavity of the head and having a valve stem and a valve head, wherein the valve head is positioned adjacent the cylinder opening for being moved between:

1) an open position of the cylinder opening, wherein, gas flow is enabled between the cylinder bore and the head; and 2) a closed position of the cylinder opening, wherein, gas flow is disabled between the cylinder bore and the head;

b) sensor means for determining the position of the crankshaft and producing a position signal in response thereto;

c) command mechanism, coupled to the sensor means, for processing the position signal and producing a variable valve drive signal in response thereto; and d) an actuator electrically coupled to the command mechanism, for intermittently and variably moving the valve between the open and closed position in response to the variable valve drive signal received from the command mechanism, the actuator including a rack and pinion gear system for transforming rotary motion from a motor into linear motion of the valve, the valve being connected with a rack moving in a linear non-rotatable motion, and the pinion engaging with the rack and being coupled to said motor to rotate the pinion.

2. The valve assembly as specified in claim 1, wherein the drive signal is variable with time.

* * * * *